US010251439B2

(12) United States Patent
Rolfe

(10) Patent No.: US 10,251,439 B2
(45) Date of Patent: Apr. 9, 2019

(54) HOOD APPARATUS

(71) Applicant: Sirena Rolfe, Westminster, CO (US)

(72) Inventor: Sirena Rolfe, Westminster, CO (US)

( * ) Notice: Subject to any disclaimer, the term of this patent is extended or adjusted under 35 U.S.C. 154(b) by 162 days.

(21) Appl. No.: 15/173,642

(22) Filed: Jun. 4, 2016

(65) Prior Publication Data

US 2016/0278465 A1 Sep. 29, 2016

Related U.S. Application Data

(63) Continuation-in-part of application No. 14/262,799, filed on Apr. 27, 2014, now abandoned.

(60) Provisional application No. 61/816,734, filed on Apr. 27, 2013.

(51) Int. Cl.
*A41D 3/00* (2006.01)
*A42B 1/04* (2006.01)

(52) U.S. Cl.
CPC ..... *A42B 1/048* (2013.01); *A41D 3/00* (2013.01); *A41D 2200/20* (2013.01)

(58) Field of Classification Search
CPC ..... A41D 2200/20; A42B 1/048
See application file for complete search history.

(56) References Cited

U.S. PATENT DOCUMENTS 1,485,392 A 3/1924 Halek
3,698,014 A 10/1972 Little et al.
5,369,809 A 12/1994 Hall
5,606,746 A 3/1997 Shelton et al.
6,023,787 A * 2/2000 French ..... A41D 13/1153 2/173
6,370,692 B1 4/2002 Duyn et al.
2002/0095712 A1* 7/2002 Fayle ..... A41D 3/00 2/84
2005/0108804 A1* 5/2005 Bush ..... A41D 3/00 2/84
2005/0241045 A1* 11/2005 Tolton ..... A42B 1/048 2/84
2016/0029727 A1* 2/2016 Chang ..... A41D 1/00 2/84

* cited by examiner

*Primary Examiner* — Sally Haden
(74) *Attorney, Agent, or Firm* — Roger A. Jackson

(57) ABSTRACT

A hood apparatus has structure to be removably engagable to a jacket and further structure to help eliminate reduced user peripheral vision from the hood via the user turning their head side to side. The structure of the hood is to create a slackened removable engagement between the hood and the jacket. Further structure of the hood is to provide multiple axes of adjustability for the hood to form around a user's head in effect causing the hood move in lockstep to the user's side to side head movement. These multiple axes of adjustability include a circumferential elastic drawstring positioned about the user's face periphery and an added independent lateral elastic drawstring that is partially parallel to the circumferential elastic drawstring for about an upper one-third of the user's face periphery wherein the lateral elastic drawstring is routed laterally toward the rear of the hood.

6 Claims, 9 Drawing Sheets

HOOD APPARATUS

RELATED PATENT APPLICATION

This is a continuation in part (CIP) patent application of U.S. patent application Ser. No. 14/262,799 filed on Apr. 27, 2014 by Sirena Rolfe of Westminster, Colo., U.S., that claims the benefit of U.S. provisional patent application Ser. No. 61/816,734 filed on Apr. 27, 2013 by Sirena Rolfe of Westminster, Colo., U.S.

TECHNICAL FIELD

The present invention relates generally to an apparatus for an adjustable hood system for outerwear. More specifically, the present invention relates to the field of a portable, stowable, and removably engagable hood apparatus for providing optimal hood adjustability thus providing a custom type fit for the hood to accommodate various head sizes and shapes thus increasing the user's comfort and usability of the hood during extended time periods for sports activities outside than would normally be available with the built in hood that the user's desired coat would have included with it.

BACKGROUND OF INVENTION

A typical hood that is included with a coat or jacket is usually a design afterthought in the amount of design utility that the hood could possess, as typically the included hood with the coat or jacket usually has a face opening having a periphery with a circumferential elastic drawstring positioned within a fold about the user's face within a margin passageway of the hood face opening. The drawstring has a free end extending beyond the termination of the margin passageway at each end of the hood face opening that faces downward, resulting in two drawstring free ends. Wherein the drawstring free ends typically are able to be "cinched up" at each free end to add axial tension to the drawstring thus resulting in a reduction in the face opening via reducing the periphery to wrap the hood around the front of the user's face thus limiting environmental exposure of the user's face to eyes, nose, and mount of the user. This face opening periphery adjustment is usually the sole adjustment available on a typical hood.

There are numerous problems with the above mentioned single drawstring adjustment hood system, primarily being that the hood has a substantially rigid attachment to the jacket about a long axis that goes through the user's head, neck, torso, and legs, such that when the user turns their head from side to side, the hood keeps the face opening periphery in a single orientation facing forward thus causing the user to lose their peripheral vision quickly as their head turns within the substantially rigid hood assembly, that is caused from the hood having a loose fit to an outer surface of the user's head with the face opening periphery being reduced in size or area resulting in limiting the user's access through the hood to the external environment to be facing forward only, thus being very inconvenient for the user in sporting activities wherein the user turns their head side to side quite frequently. The loose fit of the hood to the user's head outer surface is of necessity to accommodate the largest head size of any user and to accommodate other items that are adjacent to the user's outer head surface such as eye glasses, sunglasses, headphones or earphones, hats, earmuffs, headbands, and the like.

A way to help alleviate this problem is to leave the drawstring in a loose state, thus resulting in a larger face opening periphery to expand the ability of the user to have increased peripheral vision when turning their head side to side, however, doing this causes another problem in that the hood has opening gaps around the user face periphery that can destroy the function of the hood to help keep the user's head warm, in allowing inside of the hood cold wind, snow, sleet, or rain to enter the hood through the opening gaps around the user's face periphery, this issue is especially acute when the user is moving forward through the external environment when running, bicycling, and the like. So basically the typical jacket hood is really only useable when the user is only facing forward and not turning their head side to side, being usually not the case. Wherein, the typical hood assembly that comes with a jacket is only of minor benefit to the user.

Of course an alternative could be for the user to use a stocking cap for head warmth that does not have the problem of the loss of user peripheral vision when the user turns their head side to side as the stocking cap is not attached to the jacket and rotates with the head, however, this brings on another problem in that the stocking cap fails to provide warmth or shelter for the user's neck, being a problem in cold wet weather, further if the user in engaged in high head movement activities, the stocking cap will not stay attached to the head well, unless of course a chin strap is used with the stocking cap, however, still having the aforementioned problem of the user's neck being exposed to wet and cold weather.

These hood problem issues have been somewhat identified in the prior art with a summary given below.

Starting with U.S. Pat. No. 5,606,746 to Shelton, et al., disclosed is an article of clothing including a vest portion and a detachable hood having a polyacrylamide copolymer filler that cools the body by activating the cooling stage, which is done by placing the vest and hood in water for the required time or placing the vest and hood in ice water for required time. In Shelton, the top and bottom pieces of material will dry and the filler will remain cool and moist for use in hot weather, the top and bottom pieces are worn by placing on the body and attaching fasteners and will keep the individual user cool for hours and the top and bottom pieces are made of materials that can be washed by the individual user, wherein they can be stored for days in plastic bags in the refrigerator. Also, in Shelton, if long-term storage is needed, the top and bottom pieces can be line-dried and then put away until ready for use again.

Further, in the prior art in U.S. Pat. No. 1,485,392 to Halek, disclosed is a long loose overcoat to which a hood or helmet is detachably affixed by three buttons—intermediate the shoulders immediately beneath the rear side of a soft single-ply collar bordering the neck opening of the coat, see column 2, lines 65-71. In addition, Halek teaches elements 9 and 10, wherein the hood is sewed for side vision being a fixed relationship as between elements 9 and 10, see FIG. 1 in particular, note that Halek does not teach the use of elastic string for forming the hood to the user's outer surface of their head, thus as soon as the user in Halek turns their head side to side they will lose their peripheral vision as the hood will stay rigidly attached to the coat having only a forward facing opening as previously identified as one of the problems for current hoods.

Continuing, in U.S. Pat. No. 6,370,692 to Duyn, et al. disclosed is a waterproof garment that includes a jacket and a hood which is convertible into a ventilated carrying bag for storing the jacket. In Duyn, a ventilated waterproof hood includes an inner ventilated material and an outer waterproof layer having an interior surface and an exterior surface. Wherein the outer waterproof layer in Duyn includes at least two side portions; a top of the head portion abutting the side portions, the top of the head portion comprising a front of the head portion and a back of the head portion; a base of the neck portion; and a back portion, the back portion extending from the back of the head portion to the base of the neck portion and extending from one side portion to the other side portion, as best shown in FIGS. 1 through 5. The inner ventilated material in Duyn is attached to the back of the head and to the two side portions of the interior surface of the outer waterproof layer, and the inner ventilated material defines a ventilated pocket in the ventilated waterproof hood. Duyn does teach an elastic string at element 45, see FIGS. 5 through 11, however, that forms the pocket for storing the jacket, thus elastic string 45 has no function related to retaining the hood to the user's head in any unique way, further Duyn teaches a conventional user face periphery elastic drawstring, see element 70 in FIGS. 3 through 5.

Next, in U.S. Pat. No. 5,369,809 to Hall, disclosed is an adjustable hood system including a pair of drawstrings, see element 16 in FIG. 1, extending from the two temple areas, see element 18 of FIG. 1, of the wearer to the area corresponding to the nape of the neck, see eyelets element 22 in FIG. 1, wherein the drawstrings 16 are cinched at lock element 28, see FIGS. 1 and 2. In Hall, the drawstrings 16 provide both vertical and lateral adjustability being angled therethrough passageways element 14, see FIGS. 1 and 2, around the head of the wearer to allow the wearer to customize the fit of the hood, regardless of the size of the wearer's head or the amount of layers of headgear under the hood, however, passageways 14 have more of a vertical orientation tending to pull the hood backwards from and off of the forehead upwardly at the temple fixed attachment area (for drawstrings 16) to and toward the nape of the user's neck, thus resulting in crown area element 19 being pulled over the top portion of the user's head towards the back or nape of the user's neck, see FIG. 1, also see column 4, lines 10-18, this leaves shell area element 24, 26 as shown in FIG. 1, to remain loose in relation to the user's head as in a conventional hood, or the area that remains loose is in-between passageways 14 and collar panel 23, also as shown in FIG. 2.

Further, in Hall, the drawstrings 16 are completely independent from the conventional drawstrings 36, thus resulting in the drawstrings only are cinched tight the crown area element 19 is not secured at all to the user's head, especially the user's forehead area, in fact Hall teaches the use only of the drawstrings 16 by stating that a simple single singular motion by the user is used for hood adjustment, wherein the conventional drawstrings 36 are optional to use, see column 2, line 40 to column 3, line 10, this teaching in Hall would leave the shell area element 24, 26 as shown in FIG. 1, to remain loose in relation to the user's head as in a conventional hood, or the area that remains loose is in-between passageways 14 and collar panel 23, also as shown in FIG. 2, wherein the loose shell area element 24, 26 could block peripheral vision of the user and allow for cold air and moisture to enter the hood. Also, in Hall, drawstring element 36 functions as a conventional user facial periphery drawstring as shown in FIGS. 1 and 2, having the previously mentions problems of reducing the user's peripheral side vision when the user turns their head side to side about the long axis.

Next, in U.S. Pat. No. 3,698,014 to Little, et al. disclosed is a combination jacket and hood in which the hood is attached to the neckline of the jacket by a strip of flexible fabric, such as a knitted piece or termed a strip element 8, as shown in FIGS. 2, 3, and 4, which permits the hood to move relative to the jacket. Thus in Little, it is recognized that the loss of user peripheral side vision is made worse by the typical fairly rigid attachment of the hood to the jacket, however, as FIG. 1 shows, the hood has a very loose fit to the user's head outer surface, wherein the user's head in turning side to side about the long axis would still allow the user's head to rotate within the hood interior, thus resulting in the user losing the side peripheral vision, as being the previously identified problem with conventional hood design and structure. Although Little claims that the hood will rotate about the long axis with the user's head rotating the same way, there is no teaching of how the hood affixes to the user's head outer surface to accomplish this.

What is needed is a portable, mobile, and easily removably engagable hood apparatus that doesn't any loose or separate require straps, clasps, fasteners, hooks or any other type of hardware for removably engaging the hood to a jacket of the user's choice, thus greatly simplifying putting on and taking off of the hood apparatus from the jacket, also resulting in a much smaller, lighter, and easy to carry hood apparatus. Further as previously identified in the cited prior art, overcoming the reduced user peripheral vision due to the hood from the user turning their head side to side about the long axis while having the hood provide maximum protection from external environment weather elements would be highly desirable.

SUMMARY OF INVENTION

Broadly, the present invention of the hood apparatus accomplishes the goals of being easily removably engagable, helping to eliminate the reduced user peripheral vision due to the hood from the user turning their head side to side about the long axis, while having the hood provide maximum protection from external environment weather elements is achieved by several unique structures. The first structure is to create a loose removable engagement as between the hood apparatus and the user's desired jacket that allows easy attaching and removing of the hood to and from the jacket respectively with a relatively loose attachment as between the hood apparatus and the jacket, thus allowing the hood apparatus to have some degree of free movement relative to the jacket about the long axis. Also, to provide multiple axes of adjustability for the hood to form around the user's head outer surface in effect causing the hood apparatus to mimic the movement of a stocking cap, such that the hood apparatus moves with the user's side to side head movement about the long axis. These multiple axes of adjustability include a traditional circumferential elastic drawstring positioned within a fabric fold about the user's face periphery within a margin passageway of the hood face opening and an added independent lateral elastic drawstring that is partially parallel to the circumferential elastic drawstring for about an upper one-third of the user's face periphery wherein the lateral elastic drawstring is routed laterally toward the rear of the hood apparatus through a pair of independent lateral passageways around the user's head with the ability of the lateral elastic drawstring being able to be cinched tight thus resulting in the hood pulling downward and tight as against the user's forehead and temples, wherein the sides of the hood are pulled back toward the user's ears resulting in several things, first; the user's peripheral side vision is maintained and second; with the hood cinched tight around the entire user's head, when the user turns their head side to side and with the hood apparatus having a loose or omnidirectionally free movement attachment to the jacket, the hood apparatus turns with the user's head to preserve the user's side peripheral vision when the user turns their head side to side while the user's upper torso stays static.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
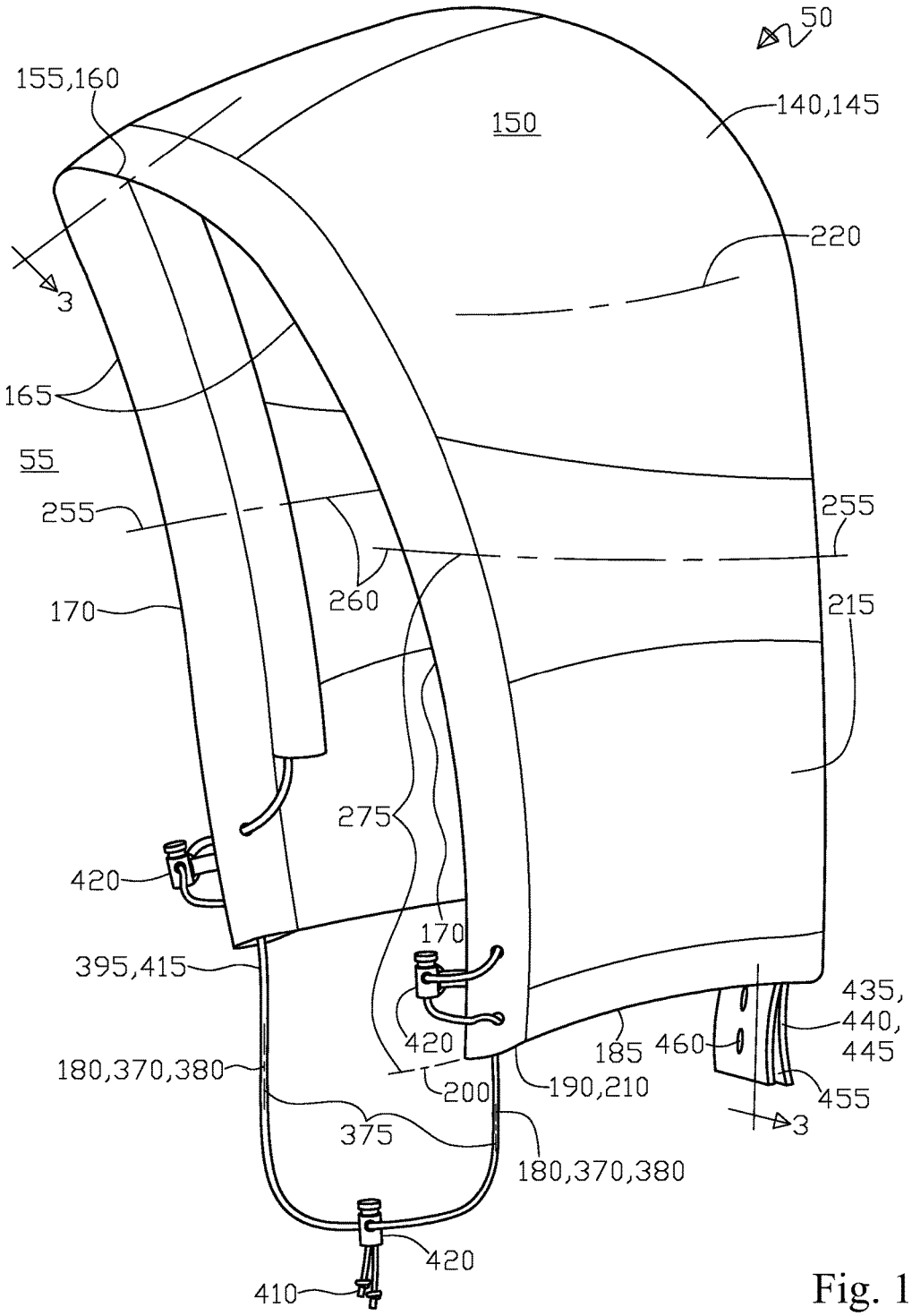
FIG. 1 shows a side and front perspective view of the hood apparatus in the external environment wherein the hood apparatus includes a flexible planar member in a formed hood shape with a head crown portion, a lower forehead portion, an adjoining border as between the head crown portion and the surrounding sidewall, a lower forehead margin, a vertical margin, and a semi-circular terminating margin.

50 Hood apparatus
55 External environment
60 Human head
65 Movement of the human head 60
70 Crown of the human head 60
75 Forehead of the human head 60
80 Facial area of the human head 60
85 Vertical side of the facial area 80
90 Ear of the human head 60
95 Upper ear lobe of the ear 90
100 Lower ear lobe of the ear 90
105 Nose of the human head 60
110 Mouth of the human head 60
115 Eyes of the human head 60
120 Neck
125 Front upper portion of the neck 120
130 Front lower portion of the neck 120
135 Nape lower portion of the neck 120
136 Upper torso of the human
140 Flexible planar member
145 Formed hood shape of the flexible planar member 140
150 Head crown portion of the formed hood shape 145
155 Lower forehead margin of the formed hood shape 145
160 Lengthwise axis of the lower forehead margin 155
165 Transitions for the lower forehead margin 155
170 Parallel terminating vertical margins of the formed hood shape 145
175 Continuation position of the terminating vertical margin 170
180 Long axis of the vertical margin 170
185 Laterally positioned semi-circular terminating margin

190 Opposing end portion of the semi-circular terminating margin 185
200 Circumferential axis of the semi-circular terminating margin 185
205 Adjacent position of the semi-circular terminating margin 185 to the nape 135 of the neck 120
210 Joining or transition of the semi-circular terminating margin 185 and the pair of terminating vertical margins 170
215 Surrounding sidewall defined as adjacent to the nape portion 135 of the formed hood shape 145
220 Adjoining point or border of the sidewall portion 215 to the head crown portion 150
225 First void
230 First passageway of the first void 225
231 Axis of the first passageway 230
235 Coincident position of the first passageway 230 to the lengthwise axis 160
240 Termination of the first passageway 230 at opposing ends at the lower forehead margin 155 transitions 165
245 Second voids
250 Second passageways of the second voids 245
255 Axis of the second passageway 250
260 Opposite positioning of the second passageways 250 to one another
265 Continuous therethrough passageway communication loop
270 Junction as between the first 230, second 250, and third 365 passageways
275 Juxtapose position of second passageway axes 255 with the circumferential axis 200
280 Termination of the second passageways 250
285 Position of the second passageways 250 termination 280 in the surrounding sidewall
215 positioned opposite of the lower forehead margin 155
290 Single second passageway 250 termination
295 Opposing second passageway 250 termination
300 Single first elastic member
305 Slidable engagement of the single first elastic member 300
310 Loop formed in the single first elastic member 300
315 Termination ends of the single first elastic member 300
320 Termination ends of the single first elastic member 300 extending beyond the surrounding sidewall 215
325 First means for retaining the first single elastic member 300 two ends 320 to one another that is preferably a spring loaded elastic string cinching clamp
330 Selectably tensioning the first single elastic member 300
335 Laterally securing of hood 50 or in particular the surrounding sidewall portion 215 about the human head 60
340 Perpendicular orientation of the lengthwise axis 160 and the second passageway axis 255
345 Drawing downward of the head crown portion 150 on the forehead 75
350 Positioning of the second passageways 250 to be proximate to the lower ear lobes 100
355 Drawing downward of the surrounding sidewall 215 on the human head 60
360 Third void
365 Third passageway of the third void 360
370 Axis of the third passageway 365
375 Parallel positioning of the third passageway axes 370
380 Coincident position of the third passageways axes 370 to the long axes 180
385 Continuous tertiary therethrough passageway communication loop
390 Termination of the third passageways 365 therethrough at the surrounding sidewall 215
395 Single second elastic member
400 Slidable engagement of the single second elastic member 395
405 Loop formed in the single second elastic member 395
410 Termination ends of the single second elastic member 395
415 Termination ends of the single second elastic member 395 extending beyond the third passageways 365 and the surrounding sidewall 215
420 Second means for retaining the single second elastic member 395 to the termination 390 of the third passageways 365 at the surrounding sidewall 215 that is preferably a spring loaded elastic string cinching clamp
425 Selectably tensioning the single second elastic member 395
430 Securing of the lower forehead margin 155 and the pair of parallel terminating vertical margins 170 to be adapted about the facial area 80 and to pull the surrounding sidewall 215 tighter to be configured around the neck 120
435 Third means for removably attaching the surrounding sidewall 215 to a jacket 500, the third means 435 is preferably a combination of a flexible strap 445 that is affixed 450 to the sidewall 215, wherein the flexible strap 445 forms a loop 455 that includes a structure 460 to removably engage the flexible strap 445 that is adapted to be about a coat hook loop 505, wherein the structure 460 facilitates the flexible strap 445 selectively being in a open state 461 or a closed state 462
440 Slackened or loosened condition of the third means 435 allowing for relative movement being defined as relative omnidirectional movement 510 as between the surrounding sidewall 215 and the jacket 500 while attached to one another
445 Flexible strap
450 Affixment of the flexible strap 445 to the surrounding sidewall 215
455 Loop formed from the flexible strap 445
460 Structure to selectably open and close or removably engage the flexible strap loop
455 about the coat hook loop 505, wherein the structure 460 is preferably a snap
461 Open state of the flexible strap 445 loop 455 that is facilitated by structure 460
462 Closed state of the flexible strap 445 loop 455 that is facilitated by structure 460
465 Rotation of the human head
470 Rotation of the coat 500 in conjunction with the upper torso 136
500 Coat or jacket
505 Loop hook for the coat 500
510 Relative omnidirectional movement between the sidewall 215 and the jacket 500

DETAILED DESCRIPTION

With initial reference to FIG. 1 shown is the side and front perspective view of the hood apparatus 50 in the external environment 55 wherein the hood apparatus 50 includes a flexible planar member 140 in a formed hood shape 145 with a head crown portion 150. Also FIG. 1 shows a lower forehead portion 155, an adjoining border 220 as between the head crown portion 150 and the surrounding sidewall 215, a lower forehead margin 155, a vertical margin 170, and a semi-circular terminating margin 185.

Figure 2:
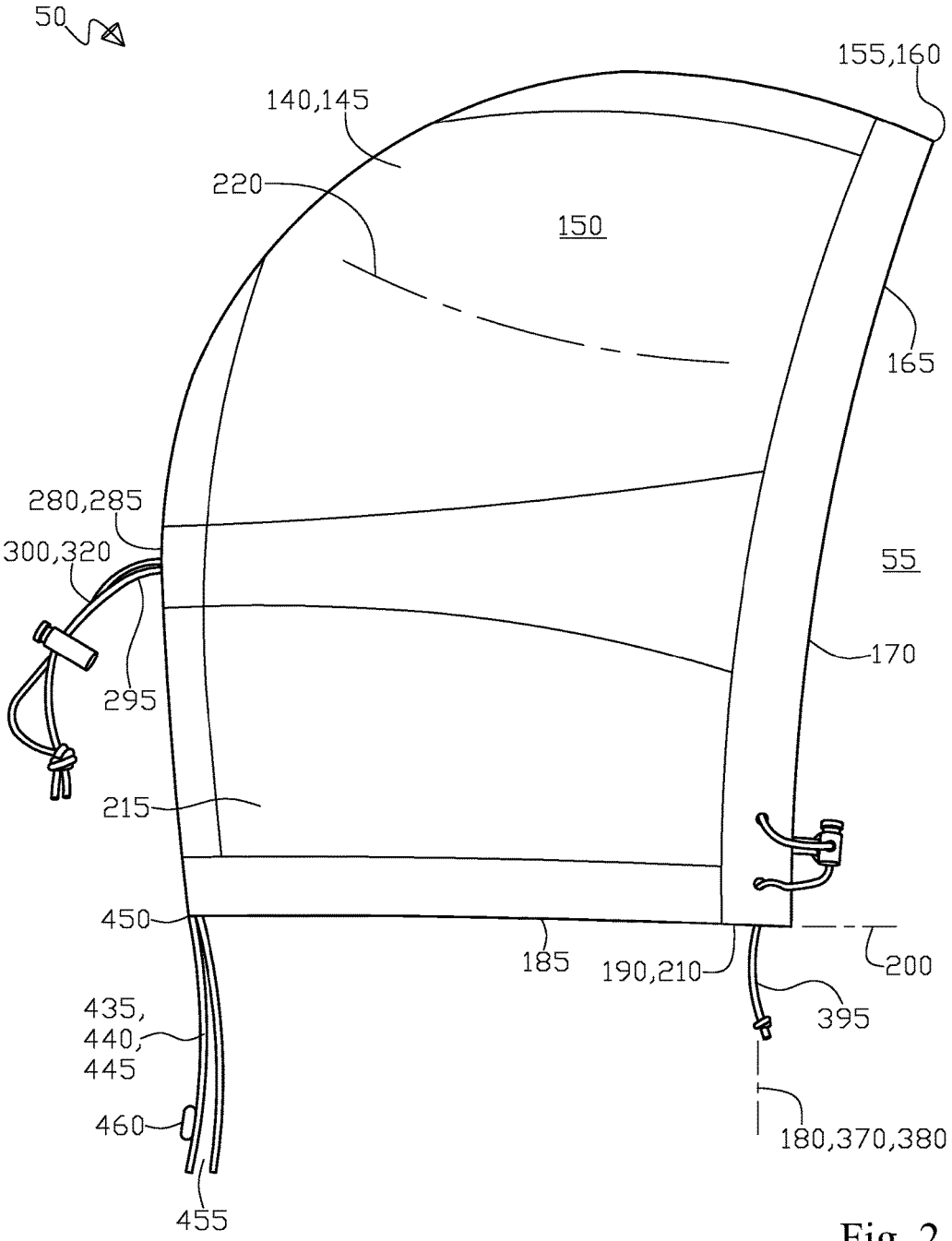
FIG. 2 shows a side elevation view of the hood apparatus in the external environment wherein the hood apparatus includes the flexible planar member in the formed hood shape with the head crown portion, the lower forehead portion, the adjoining border as between the head crown portion and the surrounding sidewall, the lower forehead margin, the vertical margin, and the semi-circular terminating margin.

Continuing, FIG. 2 shows a side elevation view of the hood apparatus 50 in the external environment 55 wherein the hood apparatus 50 includes the flexible planar member 140 in the formed hood shape 145 with the head crown portion 150. Further, FIG. 2 shows the lower forehead portion 155, the adjoining border 220 as between the head crown portion 150 and the surrounding sidewall 215, the lower forehead margin 155, the vertical margin 170, and the semi-circular terminating margin 185.

Figure 3:
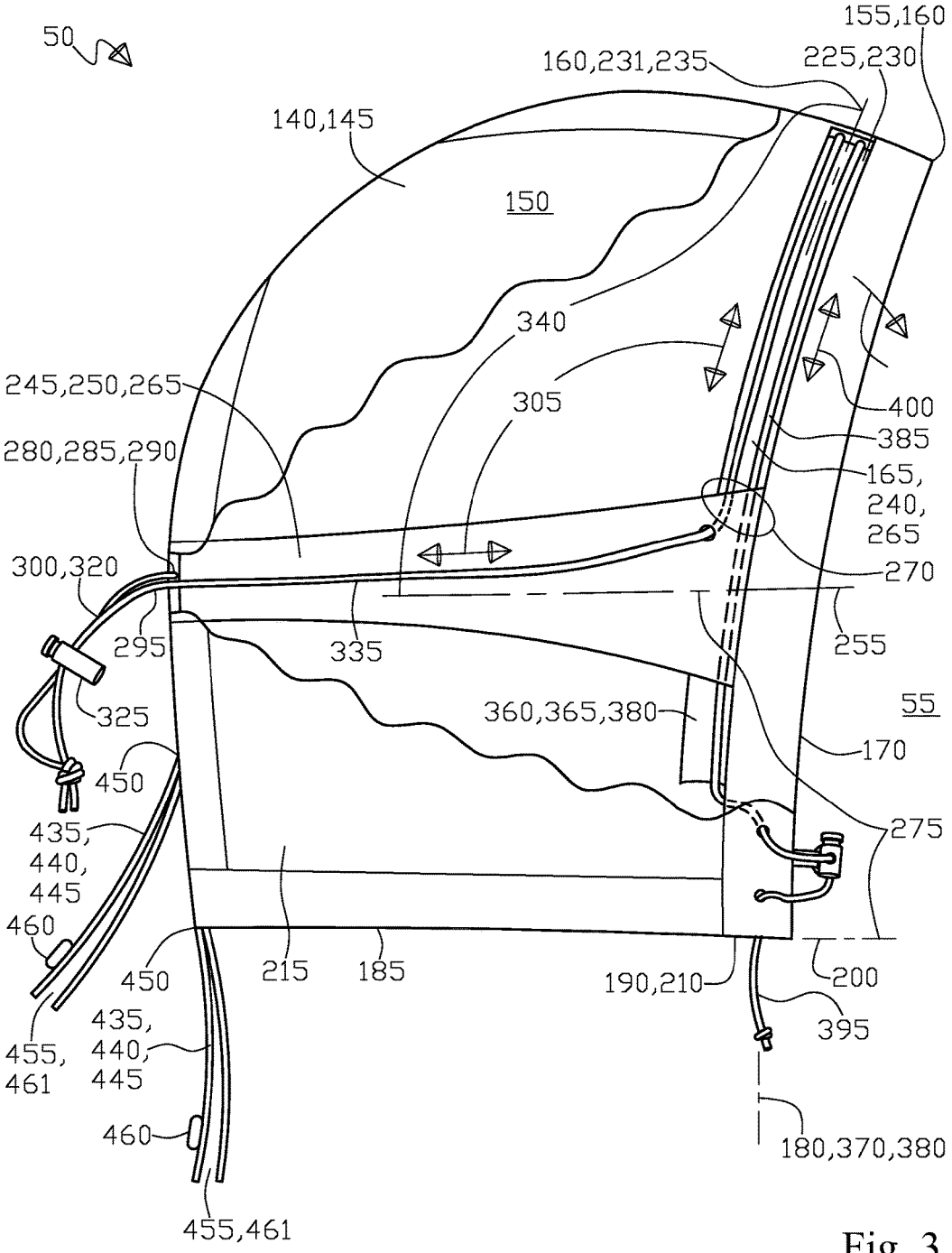
FIG. 3 shows a partial cutaway side elevation view of the hood apparatus in the external environment wherein the hood apparatus includes the flexible planar member in the formed hood shape with the head crown portion, the lower forehead portion, the adjoining border as between the head crown portion and the surrounding sidewall, the lower forehead margin, the vertical margin, and the semi-circular terminating margin, wherein further shown is a first void, a first passageway, a second void, a second passageway, a single first elastic member, and a single second elastic member.

Moving onward, FIG. 3 shows a partial cutaway side elevation view of the hood apparatus 50 in the external environment 55 wherein the hood apparatus 50 includes the flexible planar member 140 in the formed hood shape 145 and with the head crown portion 150. In addition, FIG. 3 shows the lower forehead portion 155, the adjoining border 220 as between the head crown portion 150 and the surrounding sidewall 215, the lower forehead margin 155, the vertical margin 170, and the semi-circular terminating margin 185. Wherein further shown in FIG. 3 is a first void 225, a first passageway 230, a second void 245, a second passageway 250, a single first elastic member 300, and a single second elastic member 395.

Figure 4:
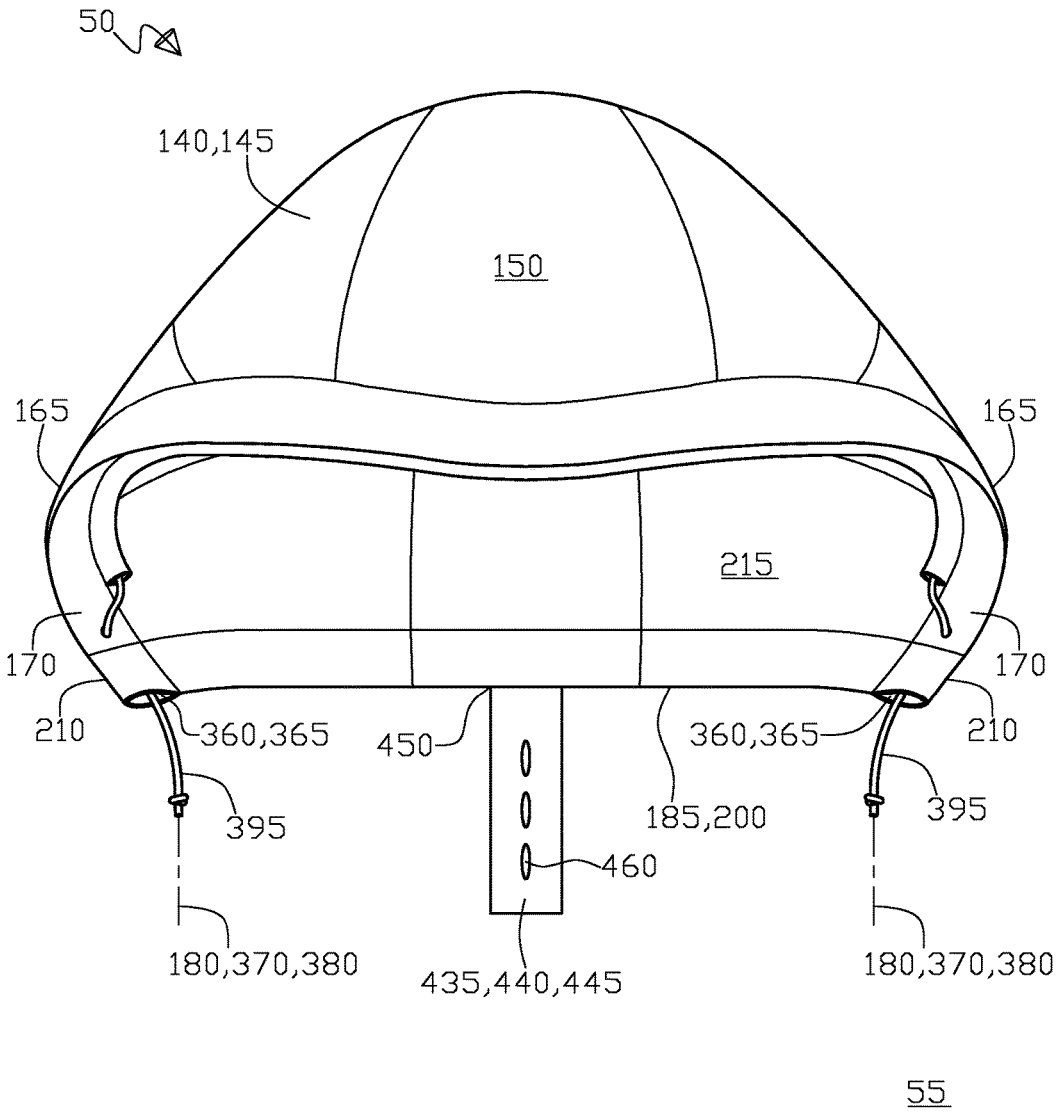
FIG. 4 shows a front perspective view of the hood apparatus in the external environment wherein the hood apparatus includes the flexible planar member in the formed hood shape with the head crown portion, the lower forehead portion, the surrounding sidewall, the lower forehead margin, the vertical margin, and the semi-circular terminating margin, the single second elastic member, and the third means for removably attaching the surrounding sidewall to the jacket.

Next, FIG. 4 shows a front perspective view of the hood apparatus 50 in the external environment 55 wherein the hood apparatus 50 includes the flexible planar member 140 in the formed hood shape 145 with the head crown portion 150. Also, FIG. 4 shows the lower forehead portion 155, the surrounding sidewall 215, the lower forehead margin 155, the vertical margin 170, and the semi-circular terminating margin 185, the single second elastic member 395, and the third means 435 for removably attaching the surrounding sidewall 215 to the jacket.

Figure 5:
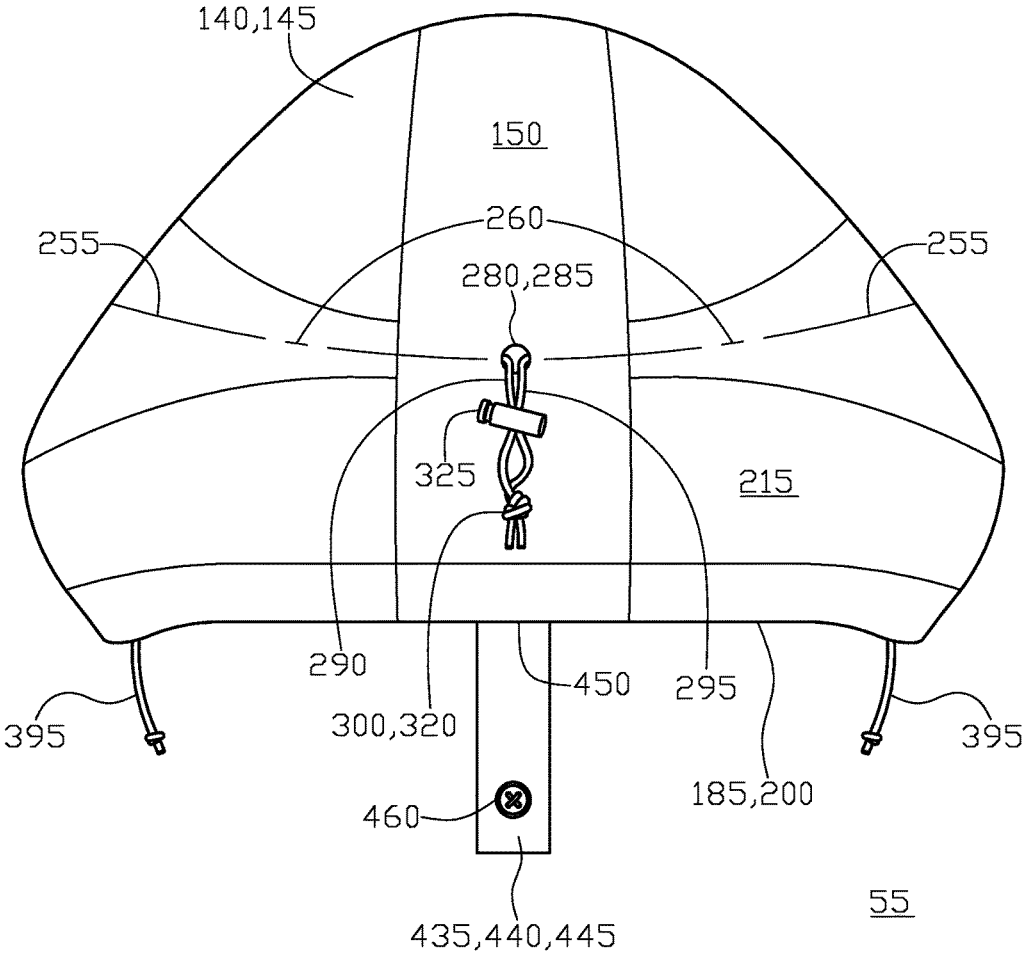
FIG. 5 shows a rear elevation view of the hood apparatus in the external environment wherein the hood apparatus includes the flexible planar member in the formed hood shape with the head crown portion, the surrounding sidewall, the single first elastic member, the single second elastic member, and the third means for removably attaching the surrounding sidewall to the jacket.

Further, FIG. 5 shows a rear elevation view of the hood apparatus 50 in the external environment 55 wherein the hood apparatus 50 includes the flexible planar member 140 in the formed hood shape 145 with the head crown portion 150. In addition, FIG. 5 shows the surrounding sidewall 215, the single first elastic member 300, the single second elastic member 395, and the third means 435 for removably attaching the surrounding sidewall 215 to the jacket.

Figure 6:
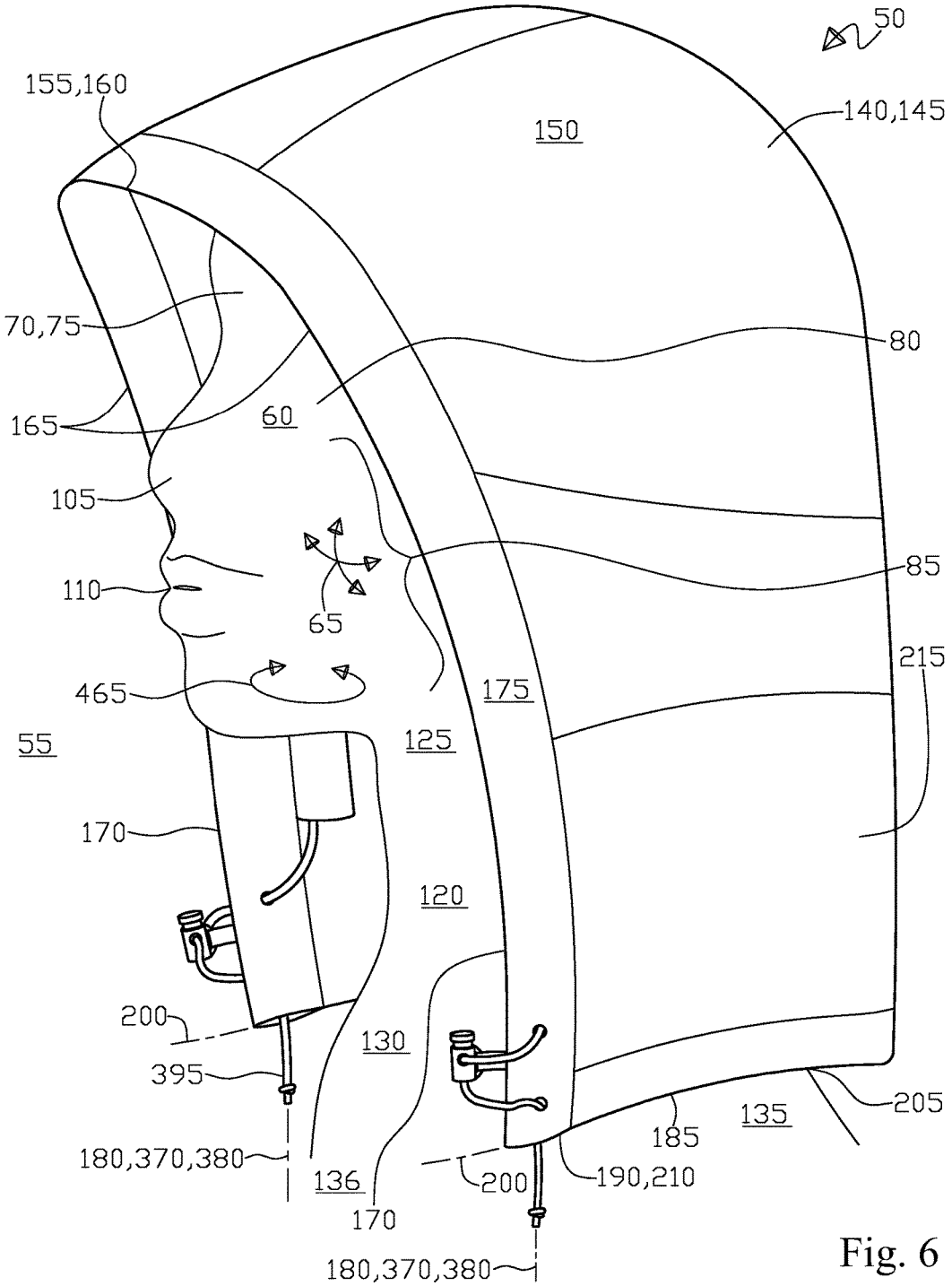
FIG. 6 shows the FIG. 1 view of the hood apparatus in use with the side and front perspective view of the hood apparatus in the external environment wherein the hood apparatus includes the flexible planar member in the formed hood shape with the head crown portion, the lower forehead portion, the surrounding sidewall, the lower forehead margin, the vertical margin, and the semi-circular terminating margin, plus features of the user that include a human head, a movement of the head, a crown of the head, a forehead, a facial area, a vertical side of the facial area, a nose, a mouth, eyes, a neck, a front upper portion of the neck, a front lower portion of the neck, and a nape of the neck.

Continuing, FIG. 6 shows the FIG. 1 view of the hood apparatus 50 in use with the side and front perspective view of the hood apparatus 50 in the external environment 55 wherein the hood apparatus 50 includes the flexible planar member 140 in the formed hood shape 145 with the head crown portion 150. Further, FIG. 6 shows the lower forehead portion 155, the surrounding sidewall 215, the lower forehead margin 155, the vertical margin 170, and the semi-circular terminating margin 185. FIG. 6 also shows the user features of including a human head 60, a movement of the head 65, a crown of the head 70, a forehead 75, a facial area 80, a vertical side 85 of the facial area 80, a nose 105, a mouth 110, eyes 115, a neck 120, a front upper portion 125 of the neck 120, a front lower portion 130 of the neck 120, and a nape 135 of the neck 120.

Figure 7:
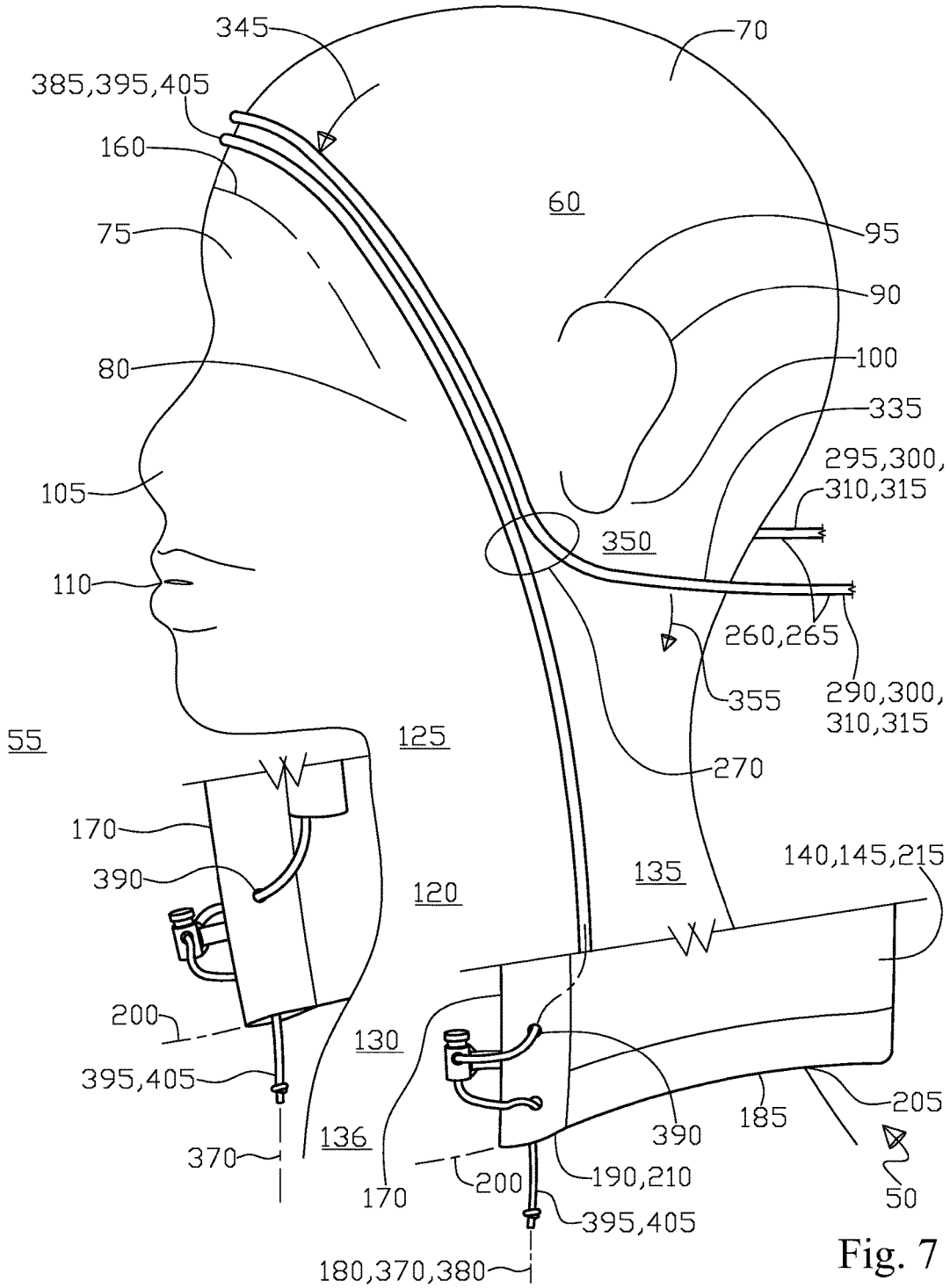
FIG. 7 shows the user of FIG. 6 with most of the hood apparatus stripped away to more clearly show the single first elastic member and the single second elastic member, wherein the relationship of the first and second single elastic members is shown in position on the head.

Next, FIG. 7 shows the user of FIG. 6 with most of the hood apparatus 50 stripped away to more clearly show the single first elastic member 300 and the single second elastic member 395. Such that FIG. 7 shows the relationship of the first 300 and second 395 single elastic members as shown in position on the head 60, further shown is an ear 90, an upper ear lobe 95, and a lower ear lobe 100.

Figure 8:
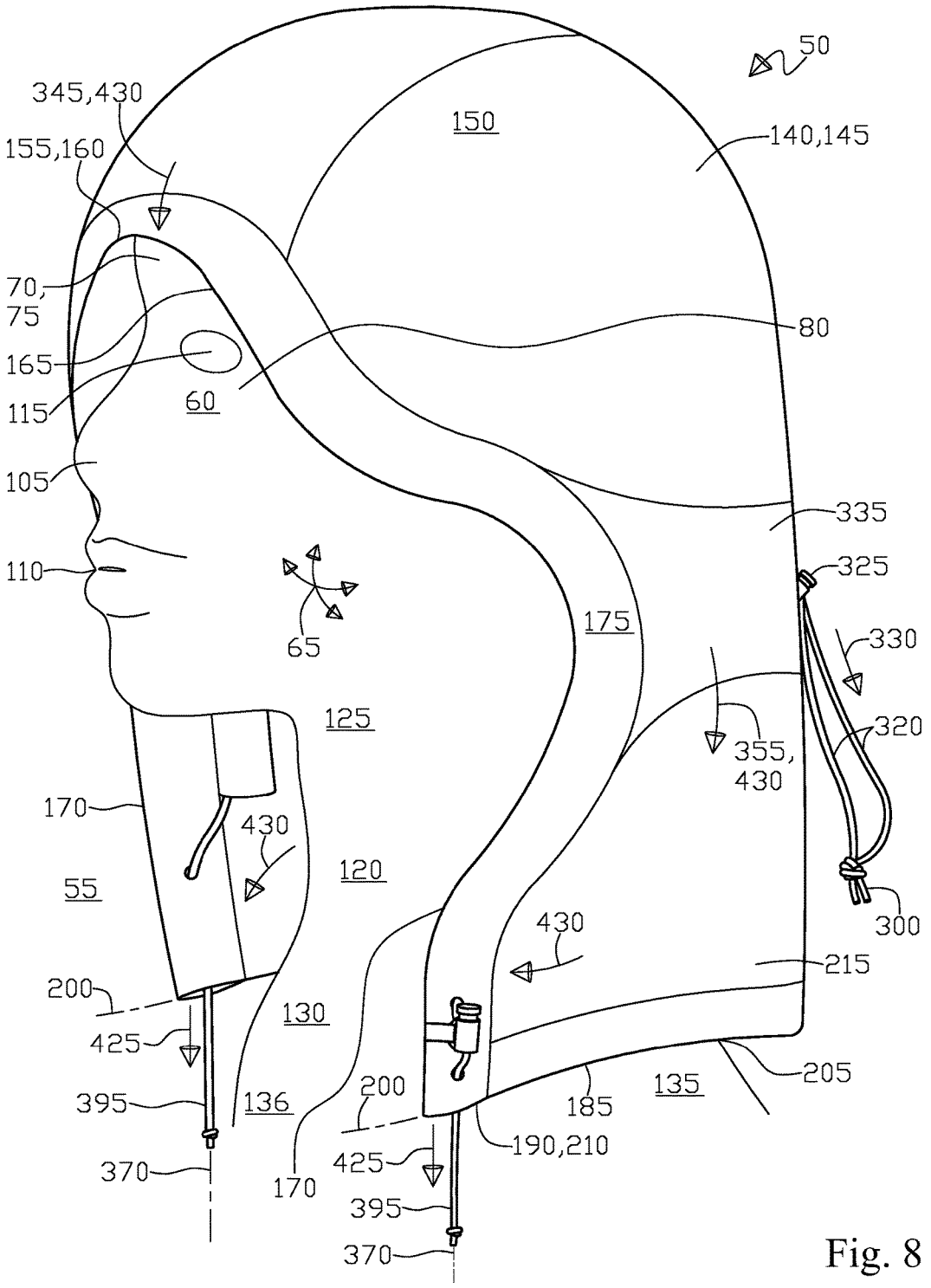
FIG. 8 shows the FIG. 6 view of the hood apparatus in use with the single first elastic member and the single second elastic member both selectably tensioned to secure the lower forehead margin to the forehead, also securing the surrounding sidewall downward on the head, and securing the surrounding sidewall around the neck.

Further, FIG. 8 shows the FIG. 6 view of the hood apparatus 50 in use with the single first elastic member 300 and the single second elastic member 395 both selectably tensioned 330 to secure 345, 430 the lower forehead margin 155 to be adapted to the forehead 75. Also, FIG. 8 shows securing the surrounding sidewall 215 downward 355, 430 on the head 60, and securing 430 the surrounding sidewall 215 to be configured around the neck 120.

Figure 9:
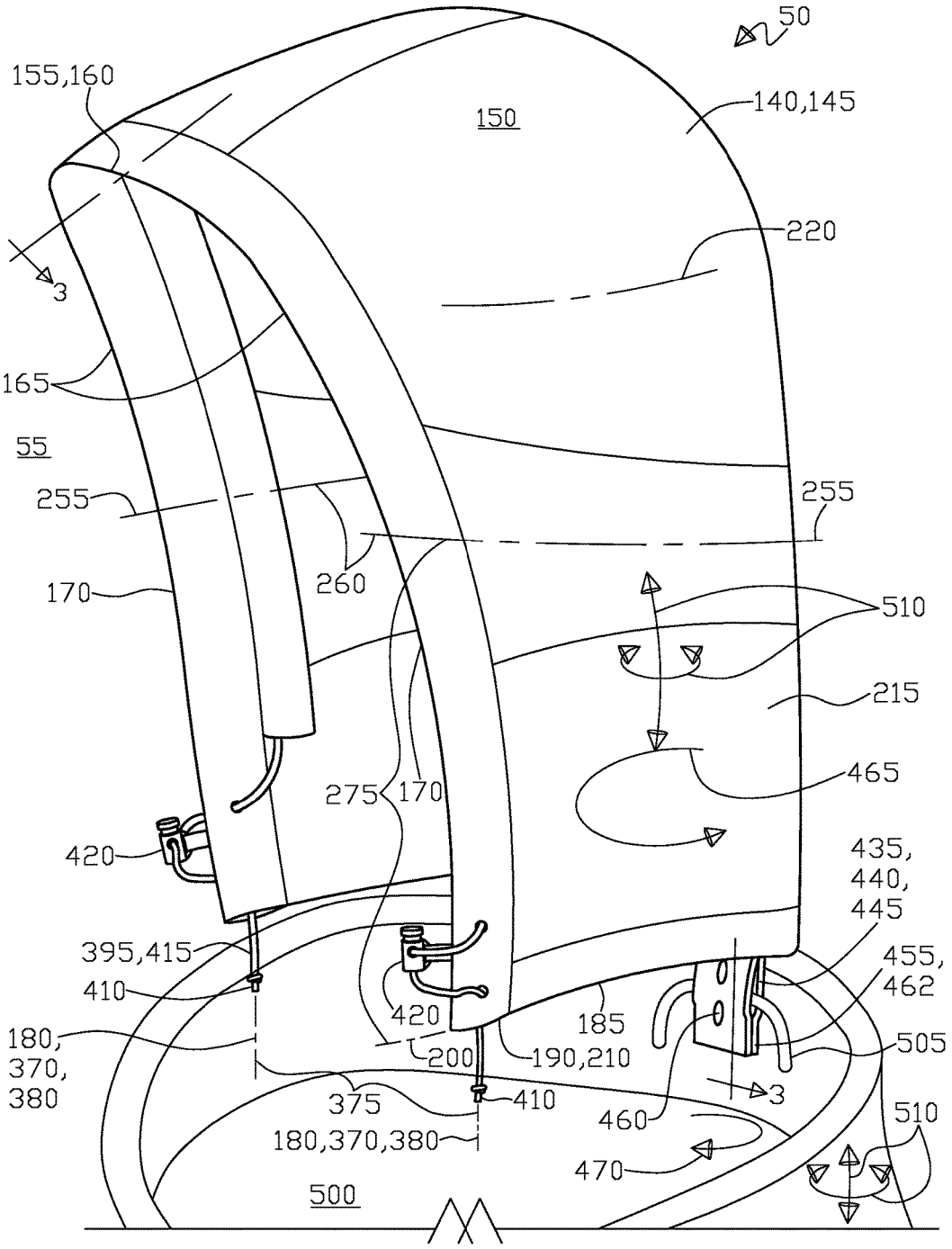
FIG. 9 being similar to FIG. 1 in that shown is a side and front perspective view of the hood apparatus that is removably engaged to a loop of a coat in the external environment wherein the hood apparatus includes a flexible planar member in a formed hood shape with a head crown portion, a lower forehead portion, an adjoining border as between the head crown portion and the surrounding sidewall, a lower forehead margin, a vertical margin, and a semi-circular terminating margin, further the rotationally loose removable engagement of the flexible strap is shown via the hood rotation and the coat rotation being able to move in opposing directions via the flexible strap loop to facilitate the hood to rotate in sync with the human head while the coat can be rotationally static thus allowing the normal neck and head rotation (for the hood) separate from upper torso lack or static rotation (for the coat), that ultimately allows for the hood to stay in a static relationship with the head rotationally thus resulting in the eyes of the human head not being obscured by the hood when the head is rotated and the upper torso is not rotated.

Next, FIG. 9 being similar to FIG. 1 in that shown is a side and front perspective view of the hood apparatus 50 that is removably engaged 460 to the loop 505 of the coat 500 in the external environment 55 wherein the hood apparatus 50 includes a flexible planar member 140 in a formed hood shape 145 with a head crown portion 150. Further FIG. 9 shows a lower forehead portion 155, an adjoining border 220 as between the head crown portion 150 and the surrounding sidewall 215, a lower forehead margin 155, a vertical margin 170, and a semi-circular terminating margin 185. In addition, FIG. 9 shows the rotationally loose removable engagement 460 that allows for relative omnidirectional movement 510 via the flexible strap 445 is shown as between the hood 50 rotation 465 and the coat 500 rotation 470 being able to move in opposing directions as shown via the flexible strap 445 loop to facilitate the hood 50 to rotate 465 in either direction being in sync with the human head 60 while the coat 500 can be rotationally 470 static being in sync with upper torso 136 of the human at relatively different movements as compared to a conventional coat/hood that must move together in lockstep to one another thus not accommodated head movement independent to upper torso movement, wherein the upper torso movement dictates movement of the hood particularly rotationally.

Thus as shown in FIG. 9 allowing the normal neck 120 and head 60 rotation 465 (for the hood 50) separate from upper torso 136 lack or static rotation 470 (for the coat 500), that ultimately allows for the hood 50 to stay in a static relationship with the head 60 rotationally 465 thus resulting in the eyes 115 of the human head 60 not being obscured by the hood 50 when the head 60 is rotated 465 and the upper torso 136 is not rotated 470 which is the problem with a convention affixed hood and jacket. This is as opposed to a conventional hood and coat combination wherein the terminating margin 185 is affixed to the coat 500 collar which forces the coat 500 and hood to rotate laterally in sync, thus resulting in the loss of sight from the hood when the head 60 is rotated 465 and the upper torso 136 is not rotated 470, such that the head 60 rotates 465 relative to the hood such that the eye 115 is facing the hood sidewall thus blocking the sight off typically one eye 115 thus being undesirable.

Broadly in looking at FIGS. 1 to 5, the hood apparatus 50 for outerwear is disclosed for use with the human head 60 that includes the crown 70, the forehead 75, the facial area 80, the ear 90 with upper 95 and lower 100 ear lobes, the nose 105, the mouth 110, the eyes 115, the front upper 125 and lower 130 portions of a neck 120, and a nape 135 lower portion of the neck 120, as best shown in FIGS. 6 to 8 for the user particulars.

Again, looking at FIGS. 1 to 5 for the hood apparatus 50 and to FIGS. 6 to 8 for the user having the hood apparatus 50 on and in place, the hood apparatus 50 includes the flexible planar member 140 forming a hood 50 that is defined functionally in a shape 145 for being adapted to cover the human head 60 that includes the hood planar member 140 being adapted to cover the head crown 70, the head forehead 75, the nape 135 of the neck 120, the ears 90 and extending from the head crown 70 to the front portion 130 of the neck 120. Further, the flexible planar member 140 formed hood shape 145 is defined structurally by the head crown portion 150 terminating laterally in a lower forehead margin 155 having a lengthwise axis 160. The lower forehead margin 155 transitions 165 into a pair of parallel terminating vertical margins 170 configured to be on each vertical side 85 of the facial area 80 wherein each terminating vertical margin 170 continues to extend beyond the facial area 80 at a continuation position 175 to the front lower portion 130 of the neck 120, see in particular FIGS. 1 to 3, and 6.

Looking at FIGS. 1, 3, and 6, each vertical margin 170 has a long axis 180, wherein each of the vertical margin 170 transitions 210 into each of an opposing end portion 190 of the laterally positioned semi-circular terminating margin 185 that has a circumferential axis 200. The semi-circular terminating margin 185 is adapted to be adjacent 205 to the nape lower portion 135 of the neck 120, wherein the semi-circular terminating margin 185 joins the pair of terminating vertical margins 170, wherein the semi-circular margin 185 is adapted to be positioned adjacent 205 to the nape 135 of the user, see FIGS. 6 to 8. Wherein the flexible planar member 140 includes the head crown portion 150 and the partially surrounding sidewall 215 portion are defined by the pair of parallel terminating vertical margins 170, the semi-circular terminating margin 185, and the adjoining border 220 to the head crown portion 150, see FIGS. 1 and 2.

Also included in the hood apparatus 50, as best seen in FIGS. 3 and 7, is the first void 225 disposed within the lower forehead margin 155, with the first void 225 forming the first passageway 230 having a first passageway axis 231. The first passageway axis 231 is coincident 235 to the lengthwise axis 160, with the first passageway 230 terminating 240 at two opposing ends at the lower forehead margin 155 transitions 165.

In addition, included in the hood apparatus 50, also as best seen in FIGS. 3 and 7, is the pair of second voids 245 disposed within the surrounding sidewall 215 portion, the pair of second voids 245 forming the pair of second passageways 250 having a second passageway axis 255. As the second passageways 250 are positioned opposite 260 to one another in surrounding sidewall 215 portion, see FIGS. 1 and 7, the second passageways 250 are each in therethrough passageway communication 265 with the first passageway 230 at a pair of junctions 270, see FIGS. 3 and 7. Wherein, each of the first passageway 230 opposing ends 240 is in the therethrough passageway communication 265 with a single second passageway 250 at each of the junctions 270. Location wise the second passageways axes 255 are in juxtapose 275 position with the circumferential axis 200, see FIGS. 1 and 3. The second passageways 250 terminate 280 therethrough the surrounding sidewall portion 215 to the external environment 55, further the second passageways 250 terminate at the surrounding sidewall portion 215 at a location 285 positioned opposite of the lower forehead margin 155, see FIGS. 2, 3, and 5. Wherein the continuous therethrough passageway communication loop 265 is formed at the second passageways 250 termination 290 at the surrounding sidewall portion 215 in going from the single second passageway 250 termination 290 through the second passageway 250 to the first passageway 230 and continuing therethrough the opposing 295 second passageway 250 to a termination 280 of the opposing second passageway 250, see FIGS. 3 and 7.

Further included in the hood apparatus 50, as best seen in FIGS. 2, 3, 5, 7, and 8, is the first single elastic member 300 that is slidably disposed 305 therethrough in the continuous therethrough passageway communication loop 265, such that the first single elastic member 300 forms a first single loop 310. Wherein the single elastic member 300 terminates 315 in two ends 320 that extend beyond the second passageways 250 surrounding sidewall 215 termination to the external environment 55, see FIGS. 2, 3, 5, and 8.

Additionally included in the hood apparatus 50, as best seen in FIGS. 2, 3, 5, and 8, is a first means 325 for retaining the first single elastic member 300 two ends 320 to one another that is adjacent to the second passageways 250 surrounding sidewall 215 termination. This is to operationally allow the first single elastic member loop 310 to be selectably tensioned 330 resulting in the hood 50 to be laterally secured 335 configured about the human head 60 such that the hood 50 and the human head 60 are in lockstep movement 65 with one another to preserve the eyes 115, nose 105, and mouth 110 exposure to the external environment 55 therethrough the lower forehead margin 155 and the pair of parallel terminating vertical margins 170 to the external environment 55 during head 60 movement 65, see in particular FIGS. 7 and 8.

As a further option, on the hood apparatus 50, wherein the first passageway 230 lengthwise axis 231 and the second passageway 250 axis 255 are in a perpendicular orientation 340 to one another at each of the pair of junctions 270, see FIGS. 3 and 7. This is to operationally cause the head crown portion 150 to be adapted to be drawn downward 345 on the forehead 75 and simultaneously the surrounding sidewall portion 215 to be adapted to be laterally secured 355 about the human head 60 when the first single elastic member 300 is selectably tensioned 330, see FIGS. 7 and 8.

Another option on the hood apparatus 50, involves the pair of junctions 270 that are positioned at the continuation position 175, see FIGS. 3 and 7. This is to operationally facilitate the pair of oppositely positioned 260 second passageways 250 to be adapted to be located proximate 350 to the lower ear lobes 100 to help secure the crown portion 150 and surrounding sidewall 215 portion to be drawn downward 355 configured upon the head 60 to secure the hood 50 to the head 60 and to protect the ears 90 from the external environment 55, see in particular FIGS. 7 and 8.

Another option of the hood apparatus 50, in looking at FIGS. 1 to 8, is on the pair of parallel terminating vertical margins 170 that can each further comprise a third void 360 forming a third passageway 365 having a third passageway axis 370. Wherein each third passageway 365 is disposed within each parallel terminating vertical margin 170 forming a pair of third passageways axes 370 that are positioned parallel 375 to one another and coincident 380 to the long axis 180, see FIG. 1 in particular. The third passageways 365 are each in a tertiary therethrough passageway communication 385 with the first passageway 230 at the pair of junctions 270, see FIGS. 3 and 7. Wherein each of the first passageway 230 opposing ends 240 is in the tertiary therethrough passageway communication 385 with a single third passageway 365 at each of the junctions 270, the third passageways 365 terminate 390 therethrough the surrounding sidewall portion 215 to the external environment 55 at the opposing end portions 10 of the laterally positioned semi-circular terminating margin 185, see FIG. 1, and FIGS. 6 to 8. Wherein, a continuous tertiary therethrough passageway communication loop 385 is formed from a third passageway termination 390 through a third passageway 365 to the first passageway 230 and continuing therethrough the parallel 375 third passageway 365 to a termination 390 of the parallel 375 third passageway 365.

A further option on the hood apparatus 50, in looking at FIGS. 1 to 8, can further comprise a second elastic member 395 slidably disposed 400 therethrough the tertiary therethrough passageway communication loop 385, such that the second elastic member 395 forms a single loop 405, see FIGS. 1, 3, and 7. Wherein the second elastic member 395 terminates in two ends 410 that extend beyond 415 the third passageways terminations 390 such that each third passageway termination 390 has a single second elastic member 395 extension 415 into the external environment 55.

Another option on the hood apparatus 50, in looking at FIGS. 1 to 3 and FIGS. 6 to 8, can further comprise a pair of second means 420 for retaining each second single elastic member 395 extension 415 to each third passageway termination 390. This is to operationally allow the second single elastic member 395 loop 405 to be selectably tensioned 425 resulting in the lower forehead margin 155 and the pair of parallel terminating vertical margins 170 being adapted to secure 430 about the facial area 80 and pulling the surrounding sidewall portion 215 configured to be circumferentially tighter around the neck 120 to further prevent the neck 120 to be exposed to the external environment 55. Additionally, for the second means 420 for retaining it can be in the form of a single means 420 to selectively retain both ends 410 of the second elastic member 395 together as best shown in FIG. 1, plus as FIG. 1 shows, the pair of means 420 and the single means 420 can be used individually, i.e. either the pair of means 420 alone or the single means 420 alone or they can be used in combination such that the pair of means 420 alone and the single means 420 alone are both used together.

Alternatively on the hood apparatus 50, it can further comprise a third means 435 for removably attaching the surrounding sidewall portion 215 to a jacket such that the surrounding sidewall portion and the jacket have a slackened connection 440 while attached allowing for relative omnidirectional movement 510 as between the surrounding sidewall portion 215 and the jacket 500 while attached, see FIGS. 1 to 5 and FIG. 9 in particular.

Further, optionally on the hood apparatus 50, in looking at FIGS. 1 to 5, wherein the third means 435 can be constructed of a flexible strap 445 that is affixed 450 to the surrounding sidewall portion 215 or optionally at the semicircular terminating margin 185. The flexible strap 445 is formed into a loop 455 that engages a coat 500 hook loop 505 affixed to the jacket 500, wherein the flexible strap loop has structure 460, being preferably a button and series of mating button slots or equivalent to selectably open (placed in the open state 461) and close (placed in the closed state 462) the flexible strap 445 loop 455 about the coat 500 hook loop 505.

CONCLUSION

Accordingly, the present invention of the hood apparatus has been described with some degree of particularity directed to the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. A hood apparatus for outerwear in an external environment, said hood apparatus for use with a human head that includes a crown, a forehead, a facial area, an ear with upper and lower ear lobes, a nose, a mouth, a pair of eyes, a front upper portion of a neck, a front lower portion of the neck, and a nape lower portion of the neck, said hood apparatus comprising:

(a) a flexible planar member forming a hood shape, said flexible planar member configured for covering the human head including the crown, the forehead, the nape lower portion of the neck, and the ear, and adapted to extend from the crown to the front lower portion of the neck, said flexible planar member comprises a head crown portion terminating laterally in a lower forehead margin having a lengthwise axis, said lower forehead margin transitions into a pair of parallel terminating vertical margins that are each adapted to be on a side of the facial area, wherein each said terminating vertical margin is configured to continue to extend beyond the facial area at a continuation position to be adapted to be adjacent to the front lower portion of the neck, each of said terminating vertical margins having a long axis, wherein each of said terminating vertical margins transitions into each of an opposing end portion of a laterally positioned semi-circular terminating margin that has a circumferential axis, said semi-circular terminating margin is adapted to be adjacent to the nape lower portion of the neck, wherein said semi-circular terminating margin joins said pair of terminating vertical margins, wherein said head crown portion and a surrounding sidewall that is adapted to be adjacent to the nape portion of the neck are defined by said pair of parallel terminating vertical margins, and said semi-circular terminating margin, and said head crown portion is adjoined to said surrounding sidewall, said lower forehead margin, said pair of parallel terminating vertical margins, and said semi-circular terminating margin;

(b) a first void disposed within said lower forehead margin, said first void forming a first passageway having a first passageway axis, said first passageway axis is coincident to said lengthwise axis, said first passageway terminating at two opposing ends at said pair of parallel terminating margins;

(c) a pair of second voids disposed within said surrounding sidewall, said pair of second voids forming a pair of second passageways each of said second passageway having a second passageway axis, said second passageways are positioned opposite to one another in said surrounding sidewall, said second passageways are each in therethrough passageway communication with said first passageway, wherein each of said first passageway two opposing ends is in said therethrough passageway communication with one of said pair of second passageways, said second passageways axes are each in a juxtapose position with said circumferential axis, each of said second passageways extends through said surrounding sidewall to the external environment, each of said second passageways extends through said surrounding sidewall at a location positioned opposite of said lower forehead margin, wherein a continuous therethrough passageway communication loop is formed through said location of said surrounding sidewall where a first of said pair of second passageways extends therethrough, through said first of said pair of second passageways, through said first passageway, through a second of said pair of second passageways, and through said location of said surrounding sidewall where the second of said pair of second passageways extends therethrough;

(d) a first elastic member slidably disposed through said continuous therethrough passageway communication loop, such that said first elastic member forms a loop in said first elastic member, wherein said first elastic member terminates in two ends that extend beyond each of said second passageways to the external environment;

(e) a first means for retaining said first elastic member two ends to one another in said external environment adjacent to each of said second passageways to operationally allow said first elastic member to be selectably tensioned resulting in said hood apparatus being laterally secured about the human head such that said hood apparatus and the human head are operationally in lockstep movement with one another to preserve the pair of eyes, the nose, and the mouth from exposure to the external environment through said lower forehead margin and said pair of parallel terminating vertical margins;

(f) a pair of third voids each forming a part of each of said pair of parallel terminating vertical margins, said pair of third voids forming a pair of third passageways, each of said third passageways having a third passageway axis, wherein each of said third passageways is disposed within each of said parallel terminating vertical margins forming a pair of third passageways axes that are positioned substantially parallel to one another and coincident to said long axis, each of said pair of third passageways are in a tertiary therethrough passageway communication with said first passageway, wherein each of said first passageway two opposing ends is in said tertiary therethrough passageway communication with each one of said pair of third passageways, each of said third passageways extend through said surrounding sidewall to the external environment at each said opposing end portion of said laterally positioned semi-circular terminating margin, wherein a continuous tertiary therethrouqh passageway communication loop is formed from a first of said pair of third passageways extending through to said first passageway and continuing through to a second of said pair of third passageways;

(g) a second elastic member slidably disposed through said tertiary therethrouqh passageway communication loop, such that said second elastic member forms a single loop, wherein said second elastic member terminates in two ends that extend beyond a termination of each of said third passageways such that each third passageway termination has a second elastic member extending into the external environment; and (h) a second means for retaining said two ends of said second elastic member together to operationally allow said second elastic member to be selectably tensioned resulting in said lower forehead margin and said pair of parallel terminating vertical margins being secured about the facial area and to pull said surrounding sidewall to be circumferentially tighter around the front upper portion of the neck to further prevent the front upper portion of the neck from being exposed to the external environment, wherein said first elastic member is configured to be tensioned in a first direction and said second elastic member is configured to be tensioned in a second direction, and the first and second elastic members are configured to be tensioned independently of one another, such that said first elastic member independently tensions said lower forehead margin against the forehead in an outward manner and said second elastic member independently tensions said pair of parallel terminating vertical margins to the facial area and the front upper portion of the neck in an inward manner to selectably secure said hood apparatus to the human head.

2. A hood apparatus according to claim 1, wherein said first passageway axis and said second passageway axis are in an obtuse orientation to one another at a junction of the first passageway and the second passageway, said junction is located closer to said laterally positioned semi-circular terminating margin and further from said lower forehead margin, to operationally cause said head crown portion to be drawn downward and outward on the forehead and simultaneously said surrounding sidewall to be laterally secured about the human head when said first elastic member is selectably tensioned, said junction is positioned to operationally facilitate each of said second passageways to be located proximate to the lower ear lobes to help secure said head crown portion and said surrounding sidewall to be drawn downward upon the human head and operationally configured to protect the ear from the external environment.

3. A hood apparatus according to claim 1, wherein said second means for retaining comprises a pair of second means for retaining, wherein each end of said two ends of said second elastic member comprises one of said pair of second means for retaining, said pair of second means for retaining to operationally allow said single loop of said second elastic member to be selectably tensioned resulting in said lower forehead margin and said pair of parallel terminating vertical margins being secured about the facial area and to pull said surrounding sidewall portion circumferentially tighter around the front upper portion of the neck to further prevent the front upper portion of the neck from being exposed to the external environment.

4. A hood apparatus according to claim 1, further comprising a means for removably attaching said surrounding sidewall to said outerwear such that said surrounding sidewall and the outerwear operationally have a slackened connection while attached allowing for a relative omnidirectional movement between said surrounding sidewall and the outerwear while attached.

5. A hood apparatus according to claim 4, wherein said means for removably attaching said surrounding sidewall to said outerwear comprises a flexible strap that is affixed to said surrounding sidewall at said semi-circular terminating margin, said flexible strap is formed into a loop that has an open state and a closed state via a structure, said structure being configured to selectably open and close said flexible strap loop, wherein said flexible strap loop operationally is adapted to engage a coat hook loop affixed to the outerwear, wherein said flexible strap loop comprises said structure to selectably open and close said flexible strap loop about the coat hook loop thus making said flexible strap loop removably engagable to the coat hook loop.

6. A hood apparatus according to claim 4, wherein said means for removably attaching said surrounding sidewall to said outerwear comprises a flexible strap that is affixed to said surrounding sidewall, said flexible strap is formed into a loop that has an open state and a closed state via a structure, said structure being configured to selectably open and close said flexible strap loop, wherein said flexible strap loop is adapted to operationally engage a coat hook loop affixed to the outerwear, wherein said flexible strap comprises said structure to selectably open and close said flexible strap about the coat hook loop thus making said flexible strap removably engagable to the coat hook loop.

* * * * *